US005396259A

United States Patent [19]

Pang et al.

[11] Patent Number: 5,396,259

[45] Date of Patent: Mar. 7, 1995

[54] ERASABLE AND PROGRAMMABLE SEVEN SEGMENT DISPLAY DRIVER

[75] Inventors: Yeong-Tyan Pang; Po-Chow Wang; Zuh-Chun Fan, all of Hsinchu, Taiwan, Prov. of China

[73] Assignee: Holtek Microelectronics Inc., Hsinchu, Taiwan, Prov. of China

[21] Appl. No.: 178,514

[22] Filed: Jan. 7, 1994

[51] Int. Cl.[6] ..... G09G 3/04

[52] U.S. Cl. ..... 345/34; 345/33

[58] Field of Search ..... 345/34, 33, 49, 211

[56] References Cited

U.S. PATENT DOCUMENTS

| | | | |
|---|---|---|---|
| 3,925,777 | 12/1975 | Clark | 345/34 |
| 3,962,701 | 6/1976 | Heimbigner | 345/34 |
| 4,201,984 | 5/1980 | Inami et al. | 345/49 |
| 4,510,491 | 4/1985 | Prato | 345/34 |
| 4,622,590 | 11/1986 | Togashi | 345/211 |
| 4,799,058 | 1/1989 | Okamoto et al. | 345/211 |
| 4,914,730 | 4/1990 | Fujita | 345/34 |
| 5,248,965 | 9/1993 | Yoshimitsu | 345/211 |

*Primary Examiner*—Alvin E. Oberley
*Assistant Examiner*—Vivian Chang
*Attorney, Agent, or Firm*—W. Wayne Liauh

[57] ABSTRACT

An erasable and programmable seven segment display driver includes an oscillator, a signal source selector, a column address generator, a row address generator, a common signal driver, a segment signal driver, an EPROM array, and a seven segment display. A set of preset numerical data is stored in the EPROM memory array for display. The data stored in the memory is programmable and erasable, so numerical data can be reprogrammable in accordance with any desired display data. It is possible to lower the cost and enhance the usability and convenience of the display driver.

4 Claims, 3 Drawing Sheets

ERASABLE AND PROGRAMMABLE SEVEN SEGMENT DISPLAY DRIVER

BACKGROUND OF THE INVENTION

This invention relates to a seven segment display driver, and more particularly to a programmable and erasable seven segment display driver. The driver comprises a memory array used for storing a set of preset numerical data for display and the data stored in the memory may be reprogrammable. It is possible to lower the element cost and enhance the usability of a seven segment display driver.

The conventional seven segment display driver widely used in Personal Computers requires a plurality of metal jumpers to make a connection so as to display a set of desired numbers. As the conventional technique needs manual selection how metal jumpers are connected, man-made faults are often found in assembly. Moreover, it is noted that the use of jumpers increases the production cost and slows down the rate of production assembly. All these imperfections trouble PC case manufacturers.

SUMMARY OF THE INVENTION

Consequently, the primary object of the present invention is to overcome the drawbacks of the conventional technique mentioned above and to provide an improved seven segment display driver. In accordance with the present invention, the seven segment display driver comprises an erasable and programmable read-only memory for storing a set of preset display data. Since this invention is programmable and erasable, it is possible to store the desired display data into the memory of the display driver of the present invention. During test, the data stored in the memory may be read by computer in order to ensure the correction and reliability of the display driver. Each testing or manufacturing procedure can be automatically executed by computer, being fast and accurate. Therefore, this invention significantly minimizes manual mistakes, and hence speeds up the production rate and lowers production cost, and hence provides stronger competition ability.

In the preferred embodiment of the present invention, the seven segment display driver comprises an erasable and programmable read-only memory and a control circuit. The control circuit mainly comprises of an oscillator, a signal source selector, a column address generator, a row address generator, a common signal driver, and a segment signal driver. The signal source selector is capable of generating a signal source by receiving the oscillating signal of the oscillator, and then supplying the signal source to the column address generator and the row address generator respectively. The display data stored in the memory of the display driver may be accessed according to the column address signal generated by the column address generator and the row address signal generated by the row address generator.

The other objects and features of this invention will be more apparent from the following description taken in connection with the accompanying drawings.

DETAILED DESCRIPTION OF THE INVENTION

Figure 1:
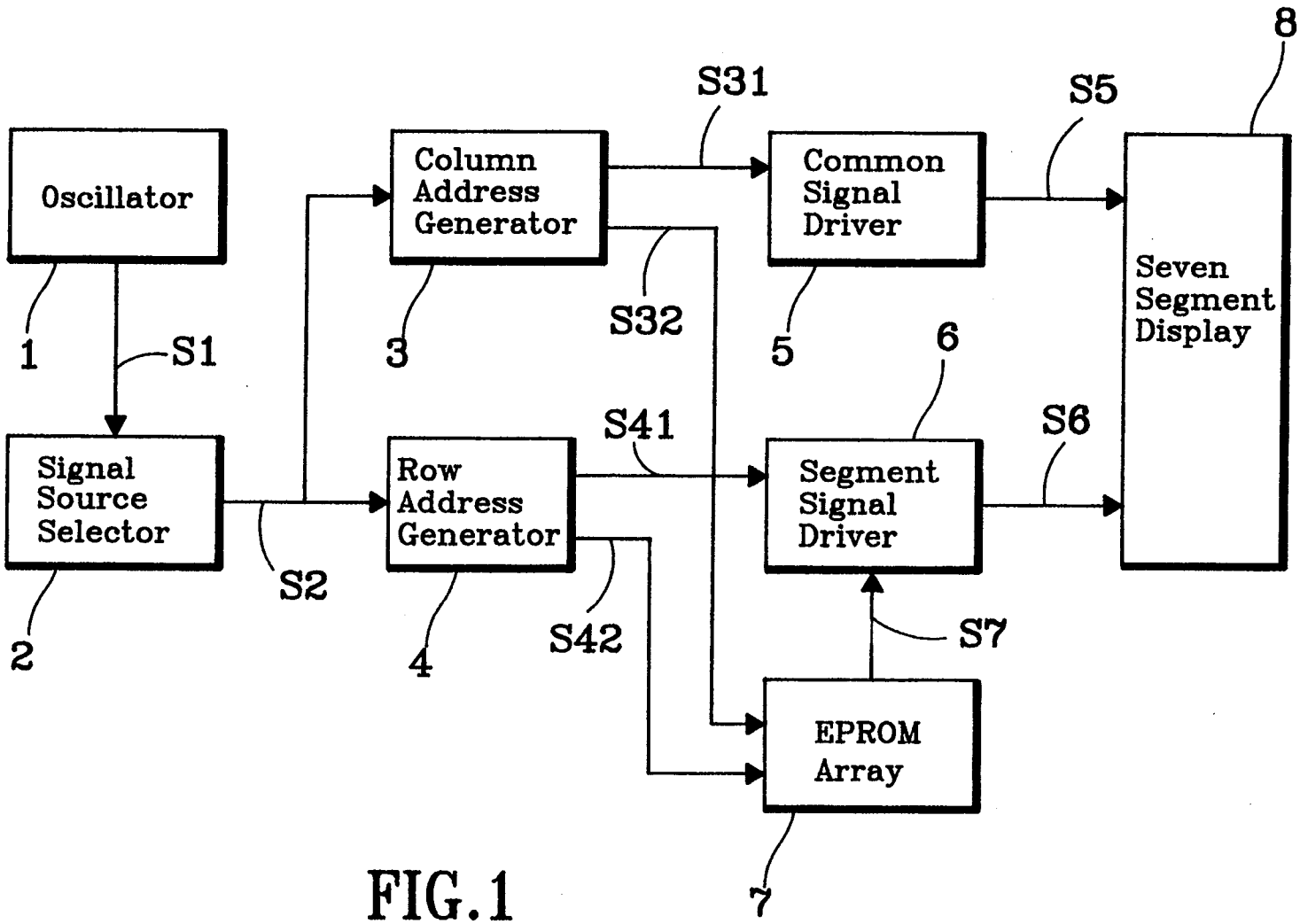
FIG. 1 is a functional diagram of the control circuit of the present invention.

Referring to FIG. 1, it is shown the functional block diagram of the control circuit of the present invention. The control circuit comprises an oscillator 1, a signal source selector 2, a column address generator 3, a row address generator 4, a common signal driver 5, a segment signal driver 6, an erasable and programmable read-only memory (abbreviated EPROM) array 7, and a seven segment display 8. The oscillator 1 has an output line S1 for transmitting an oscillating signal. The signal source selector 2 has an output line S2. The column address generator 3 has an output line S31 for outputting common signal, and has an output line S32 for outputting column address signal. The row address generator 4 has an output line S41 for outputting segment signal, and has 5 an output line S42 for outputting row address signal. The common signal driver 5 is capable of receiving and amplifying the common signal sent from the column address generator 3 via the output line S31, and then the amplified common signal will be output via its output line S5. The segment 10 signal driver 6 is capable of receiving and amplifying the segment signal sent from the row address generator 4 via the output line S41, and then the amplified segment signal will be output via its output line S6. The EPROM array 7 is capable of storing a set of preset data which may be output 15 to the segment signal driver 6 via its output line S7.

The control circuits of the present invention will be described in more detail with reference to FIGS. 1 through 5 as follows.

The Oscillator 1 is a built-in oscillating circuit capable of supplying an oscillating signal to the signal source selector 2 via the output line S1.

Figure 2:
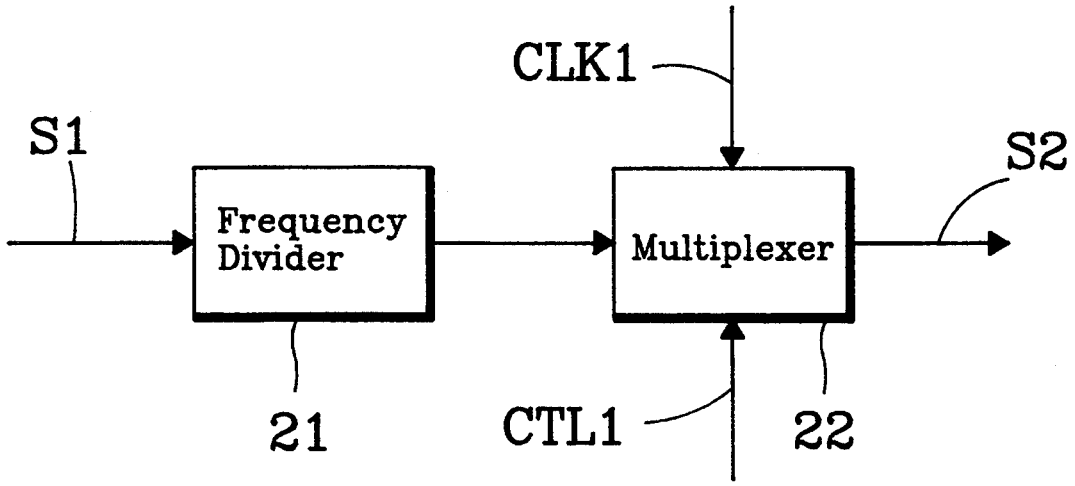
FIG. 2 is a more detailed control circuit of the signal source selector shown in FIG. 1.

The more detailed circuit diagram of the signal source selector 2 is shown in FIG. 2. This circuit includes a frequency divider 21 and a multiplexer 22. The frequency divider 21 is capable of receiving the oscillating signal generated by the oscillator 1 through the output line S1 of the oscillator 1 and then dividing the oscillating signal to a lower oscillating frequency. The divided oscillating signal will be sent to the multiplexer 22, serving as a signal source for the multiplexer during data reading procedure which will be described below.

The multiplexer 22 is capable of providing a path for the divided oscillating signal sent from the frequency divider 21 or an external clock signal, under control of a control line CTL1. During programming procedure of this invention, an external clock signal may be supplied by an external clock input line CLK1 to the multiplexer 22 and then the clock signal will be sent to the output line S2 of the multiplexer 22 under the control of the control line CTL1. During data reading procedure, the divided oscillating signal sent from the frequency divider 21 may be sent to the output line S2 via the multiplexer 22 under the control of the control line CTL1. The output signal of the output line S2 is connected to the column address generator 3 and the row address generator 4 respectively.

Figure 3:
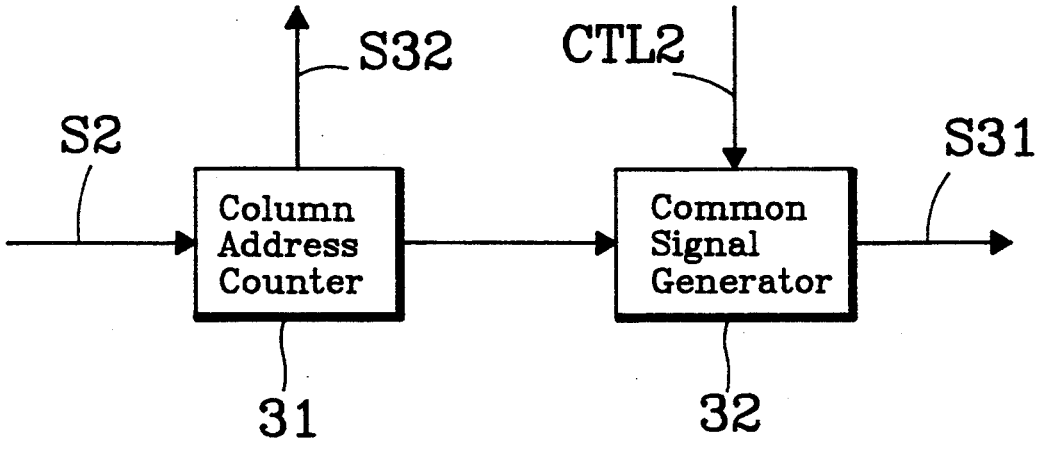
FIG. 3 is a more detailed control circuit of the column address generator shown in FIG. 1.

The more detailed circuit diagram of the column address generator 3 is shown in FIG. 3, which includes a column address counter 31 and a common signal generator 32. In a preferred embodiment of the present invention, the column address counter 31 may be a well-known Johnson Counter. The counter 31 is capable of receiving the signal source of the output line S2 sent from the signal source selector 2 and then generating a column address signal to the EPROM array 7 via the output line S32. The column address signal generated by the column address counter 31 is also sent to the common signal generator 32. The function of the common signal generator 32 is to generate a common signal to the common signal driver 5 via the output line S31, under the control of a control line CTL2. During programming procedure of this invention, the control signal of the control line CTL2 disables the common signal generator 32 to sent out its common signal. During data reading procedure, the control signal of the control line CTL2 enables the common signal generated by the common signal generator 32 to be sent to the common signal driver 5 via the output line S31.

Figure 4:
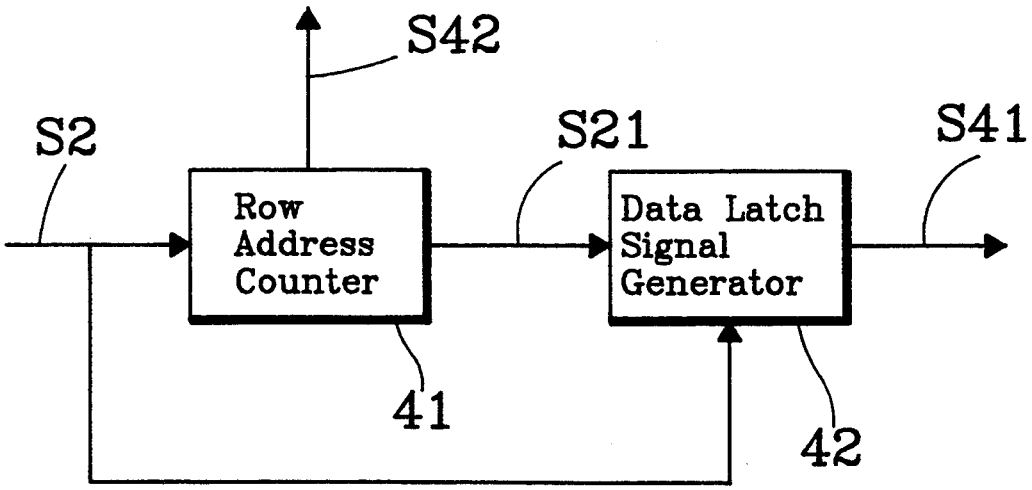
FIG. 4 is a more detailed control circuit of the row address generator shown in FIG. 1.

FIG. 4 illustrates the control circuit of the row address generator 4 in more detail, which comprises a row address counter 41 and a data latch signal generator 42. The row address counter 41 may be a Johnson counter, which is capable of receiving the signal source of the signal source selector 2 via the output line S2, and then generating a row address signal to the EPROM array 7 via the output line S42. At the same time, the row address signal is also sent to the data latch signal generator 42 via an output line S21 of the row address counter 41. The data latch signal generator 42 is capable of receiving the row address signal of the output line S21 sent from the row address counter 41 and the signal source of the output line S2 sent from the signal source selector 2. Thereafter, the data latch signal generator 42 will generate a latch signal to the segment signal driver 6 via the output line S41. The latch signal generated by the data latch signal generator 42 serves as a segment signal for the segment signal driver 6 to latch the data read from EPROM array 7.

The common signal driver 5 serves as an amplifier circuit capable of amplifying the column address signal sent from the column address generator 3 via the output line S31. The amplified column address signal of the common signal driver 5 is sent to the seven segment display 8 via the output line S5. In the preferred embodiment of the present invention, the common signal driver 5 may be a well-known current amplifier which may enhance the current driving capacity of the common signal of the column address generator 3 to drive the seven segment display 8.

Figure 5:
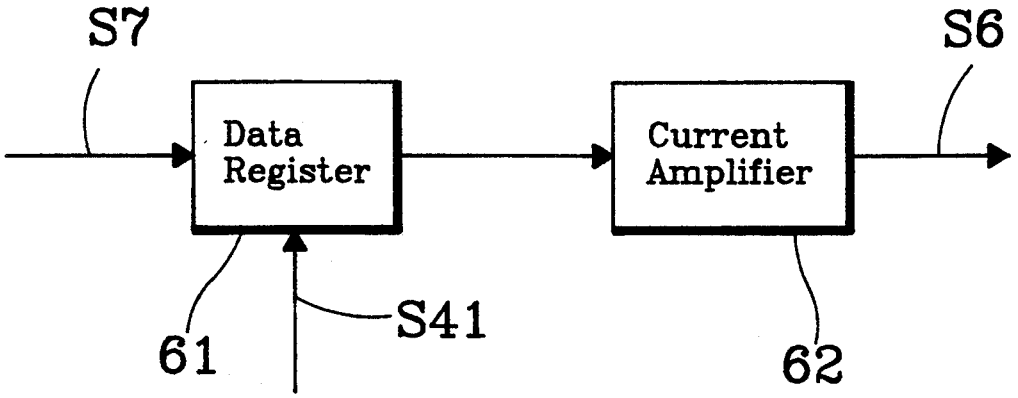
FIG. 5 is a more detailed control circuit of the segment signal driver shown in FIG. 1.

The control circuit of the segment signal driver 6 is shown in FIG. 5 in more detail. The segment signal driver 6 includes a data register 61 and a current amplifier 62. The data of the EPROM array 7 may be sent to the data register 61 via a signal line S7, and the latch signal sent from the row address generator 4 may be sent to the data register 61 via the signal line S41. The latch signal is further amplified by the current amplifier 62, and an amplified current signal is output via the output line S6 to drive the seven segment display 8.

EPROM array 7 includes a programmable and erasable read-only memory for storing preset data of a seven segment display. The data stored in the EPROM array 7 may be accessible to the seven segment display 8 via the segment signal driver 6 in accordance with the column address signal of the output line S32 sent from the column address generator 3 and the row address signal of the output line S42 sent from the row address generator 4.

So far, the feature of the preferred embodiment of the present invention has been described. Various changes and modifications may be made. For example, the EPROM array may be replaced with an electrically erasable and programmable read only memory (abbreviated EEPROM), a programmable read only memory (abbreviated PROM), or a read only memory (abbreviated ROM).

In practice, the control circuit of the present invention may be designed by the integrated circuit technique. For example, the programmable and erasable read only memory and the seven segment display driver may be packed in an integrated circuit.

It will be obvious to those skilled in the art to use this invention according to the above detailed description. While the arrangement herein described constitutes a preferred embodiment of this invention, it is to be understood that various changes and modifications may be made therein without departing from the scope and spirit of the invention as defined in the appended claim.

What is claimed is:

1. An erasable and programmable seven segment display driver, comprising:

an oscillator for providing oscillating signal;

a signal source selector for providing a signal source, which comprises a frequency divider and a multiplexer, the frequency divider receiving and dividing the oscillating signal sent from the oscillator into a lower frequency signal, the multiplexer providing a path for outputting the signal source sent from the frequency divider or an external clock signal; during programming, the external clock signal is supplied to the multiplexer, while during data reading, the oscillating signal is divided by the frequency divider and passes through the multiplexer;

a column address generator comprising a column address counter and a common signal generator, the column address counter receiving the signal source sent from the signal source selector and generating a column address signal, the common signal generator being used to generate a common signal;

a row address generator comprising a row address counter and a data latch signal generator, the row address counter receiving the signal source sent from the signal source selector and generating a row address signal to an erasable and programmable read-only memory array, the data latch signal generator receiving the row address signal sent from the row address counter and the signal source of the signal source selector to generate a segment signal;

a seven segment display for displaying numerical display data;

said erasable and programmable read-only memory array being provided for storing a set of display data and the data being sent to the seven segment display in accordance with the column address signal of the column address generator and the row address signal of the row address generator;

a common signal driver which serves as an amplifier circuit capable of amplifying the common signal sent from the column address generator; and a segment signal driver for receiving the segment signal of the row address generator, comprising a data register and a current amplifier.

2. An erasable and programmable seven segment display driver as claimed in claim 1, wherein both the row address counter of the row address generator and the column address counter of the column address generator are Johnson counters.

3. An erasable and programmable seven segment display driver as claimed in claim 1, wherein said column address counter receiving the signal source sent from the signal source selector and generating a column address signal to the EPROM array, and the common signal generator generating a common signal sent to the common signal driver.

4. An erasable and programmable seven segment display driver as claimed in claim 1, wherein said data latch signal generator generating a segment signal sent to the segment signal driver.

* * * * *